US006070270A

United States Patent [19]

De La Torre

[11] Patent Number: 6,070,270

[45] Date of Patent: Jun. 6, 2000

[54] THREE-IN-ONE TRANSFORMATION HATS

[76] Inventor: Ismael De La Torre, PMB #572, 416 W. San Ysidro Blvd., Ste. L, San Ysidro, Calif. 92173

[21] Appl. No.: 09/133,174

[22] Filed: Aug. 13, 1998

[51] Int. Cl.[7] ..... A42B 1/00

[52] U.S. Cl. ..... 2/171.1; 2/10; 2/195.1; 2/209.12

[58] Field of Search ..... 2/10, 171.1, 209.12, 2/195.1

[56] References Cited

U.S. PATENT DOCUMENTS

| | | | |
|---|---|---|---|
| 2,913,730 | 11/1959 | Schlesinger | 2/171.1 |
| 5,471,684 | 12/1995 | Casale | 2/195.1 |
| 5,548,846 | 8/1996 | Bianchetti | 2/209.12 |
| 5,613,246 | 3/1997 | Alexander | 2/10 |
| 5,669,071 | 9/1997 | Vu | 2/10 |
| 5,845,338 | 12/1998 | Clark | 2/171.1 |

*Primary Examiner*—Diana Oleksa
*Attorney, Agent, or Firm*—Patent & Trademark Services; Thomas Zack; Joseph H. McGlynn

[57] ABSTRACT

A head wear piece having detachable crown and visor portions which can be connected together by two adjacent facing fastener mechanisms, such as zipper edge strips, one of which is located on the crown and the other on the visor portion of the head wear. The zipper strips may be conceals by liner flaps or band strips located either inside the interior of the visor and crown or outside of them on the surface of the head ware. A separate storage and carrying container with its own zipper may be used to store and carry either the separated crown or separated visor portion of the head wear by attaching the bag around a user's waist with a belt.

3 Claims, 2 Drawing Sheets

THREE-IN-ONE TRANSFORMATION HATS

BACKGROUND OF THE INVENTION

Since the beginning of recorded time head ware has been used to protect the user's head, to distinguish one person over another and to provide a decorative head dress for the user. Normally, hats or caps, the terms are used interchangeability herein, are made as one unitary structure with or without a front outstanding brim to deflect some of the sunlight from the user's face. While such head ware has generally proven to be acceptable for its intended purpose, there are times less head ware may be desired by the user without having to have multiple caps or hats. The present invention relates to a single three-in-one head piece that can be used as a conventional head piece or transformed into a visor or a brimless head covering. A useful accessory for storing the brimless top portion is a storage bag that can be closed and secured around a user's waist.

DESCRIPTION OF THE PRIOR ART

Hat or caps, hereafter referred to as head ware, can have detachable components, For example, in U.S. Pat. No. 5,471,684 to Casale a convertible sports cap with a sliding brim is disclosed. A male-female connector is located at the interface between the brim and head covering portion which can be detached from each other by sliding the brim along the length of the periphery of the cap. In the Bianchetti reference (U.S. Pat. No. 5,548,846) a collapsible protective device is stored in the crown of the head ware or may be take therefrom to expand and provide a protective framework device. The Alexander patent (U.S. Pat. No. 5,613,246) discloses a cap with a removable and reversible visor. An attachment, such as a zipper, between the visor and crown is covered by a crown attached comfort liner. And in the Vu invention (U.S. Pat. No. 5,669,071) a hinge connection between the cap's crown and brim allows the brim to be folded at various angles and, by making the visor transparent, folded downwardly in front of the user's eyes to shield the eyes from sunlight or glare.

The present invention relates to head wear having a brim wherein the head wear's visor portion may be detached from the head wear's crown all as more fully set forth in this specification.

SUMMARY OF THE INVENTION

This invention relates to head wear having a visor with a brim that may be separated into components to form a crown portion and a visor or used as a single unitary head wear piece. The crown and visor components may be interconnected by a zipper strips extending completely around the circumference of the head wear.

It is the primary object of the present invention to provide for an improved head ware that may be used as a single unitary head piece or separated into its visor and crown sub components.

Another object is to provide for a head piece wherein there is a storage container for the crown portion which may be attached to a user's waist.

These and other objects and advantages of the present invention will become apparent to readers from a consideration of the ensuing description and the accompanying drawings.

DESCRIPTION OF THE PREFERRED EMBODIMENT

Figure 1:
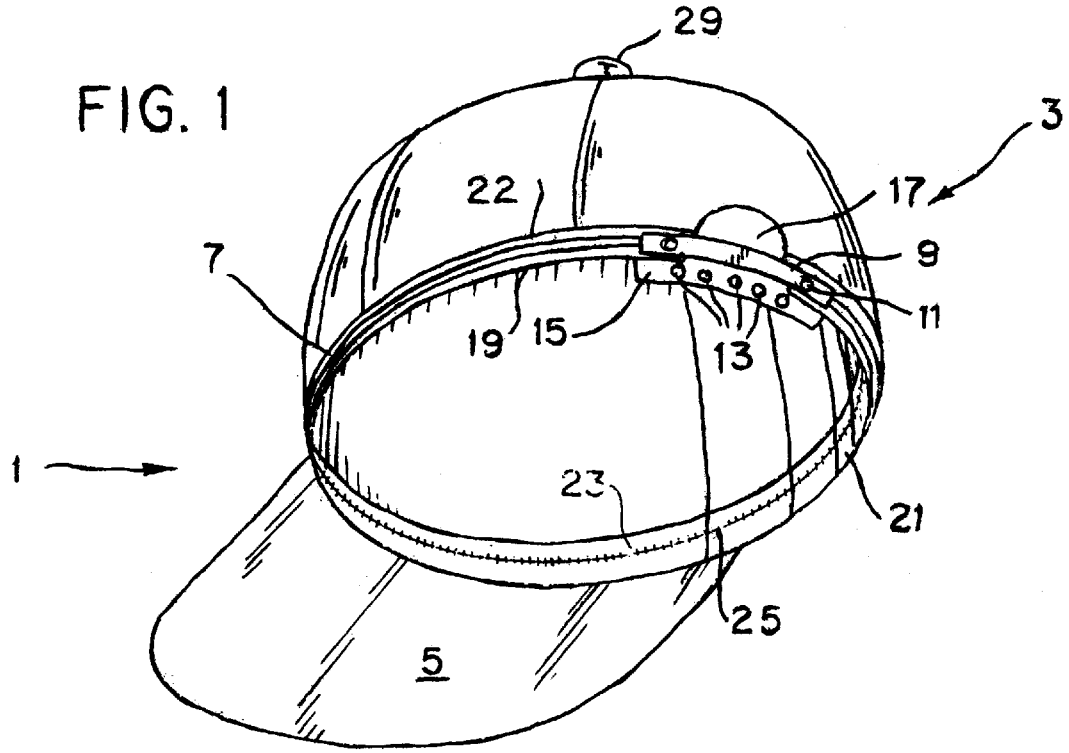
FIG. 1 is a perspective view of the invention's preferred embodiment when assembled into a single head wear piece as viewed looking upward into the interior of the crown.

FIG. 1 is a perspective view of the invention's preferred embodiment when assembled into a single head wear piece 1 as viewed looking upward into the interior of the flexible crown 3. Extending outwardly from the front of the piece 1 is the more rigid self supporting brim 5. Thus, in all outward appearances the FIG. 1 head wear resembles a conventional cap.

Encircling and fixed to lower visor portion of the head wear is the band 7 which substantially encircles most of the lower periphery of the visor portion. Where this band discontinues its two free ends join an adjustment strap 9 with an end snap button 11 used to engage one of a series of spaced protrusions 13 on a second strap on the band 15 which second strap runs in the same direction as the strap 9. One end of the first strap 9 is connected to one side of the rear adjustment opening 17 located on the side opposite the brim 5 with the strap's other end free while the second strap 15 has an end fixed to the opposite side of the opening 17 with its other strap end free. In this manner the overlapping straps 9 and 15 may vary the span distance across opening 17 by changing the engagement of the end strap snap button 11 with different protrusions 13. Also, depicted in this figure is the interior head engaging circular liner 19 used as a sweat band and overlapping interior liner flap elements 21 slightly higher up in the visor mount portion from its lower opening which flap is used to conceal two meshing fastener mechanisms or zipper edge strips located under these liner flap elements. The circling exterior strip 22 represents a line where these encircling fastener mechansims join together. Similar concealing strips 24 or bands could be used on the exterior of the head wear to prevent one from seeing that there is a connection between the two facing zipper strips.

Figure 2:
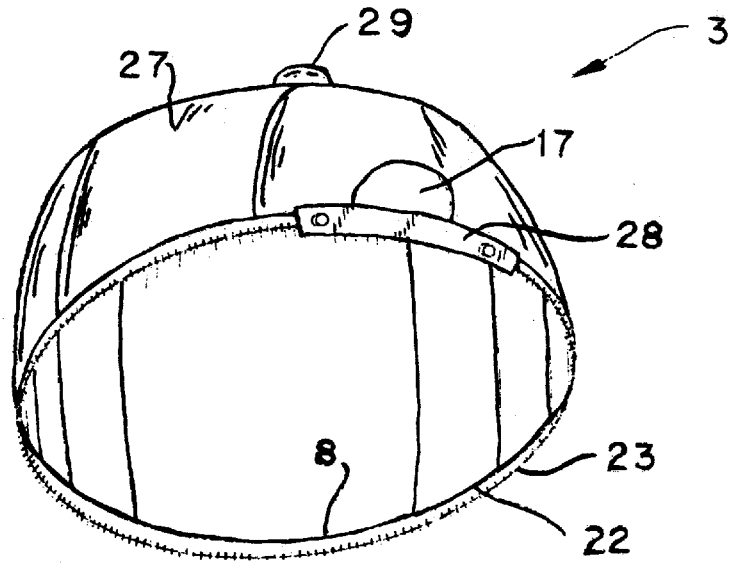
FIG. 2 is a perspective view of the crown portion of the FIG. 1 head wear as viewed from the same direction as in FIG. 1 with the visor portion removed.

FIG. 2 is a perspective view of the crown portion 3 of the FIG. 1 head wear 1 as viewed from the same direction as in FIG. 1 with the lower visor mount portion removed. The crown consists of the upper portion 22 of band liner 21 with a liner coextensive covered upper encircling zipper edge strip 23 which can engage a similar facing zipper edge strip 25 (not shown in this figure encircling the lower mating opening for the visor mount. The crown also has the generally closed and joined upper fabric sections 27 and a button 29 located on the crown's uppermost fabric joining point. The interior elastic band strap 8 extends across the opening 17 and has an elastic strap section 28 to bridge this opening. This elastic strap section 28 is not readily visible in FIG. 1 as the overlapping two visor mount straps tend to cover or obstruct most of its view from the rear. By using elastic material for the interior strap 8 and its opening section 28 the crown portion can accommodate a large amount of different sized user heads when woren alone.

Figure 3:
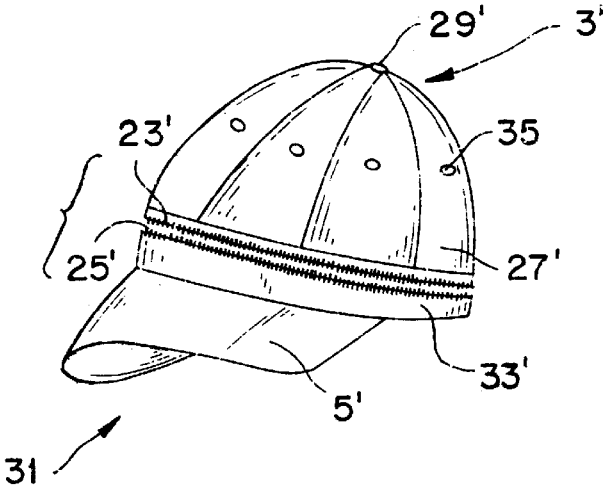
FIG. 3 shows a perspective front view of the preferred embodiment with a slightly different head wear piece with the visor portion being removed from its crown portion.

FIG. 3 shows a perspective front view of the preferred embodiment with a slightly different head wear piece with the lower visor portion 31 slightly removed from its upper crown portion 3'. Components that are the same in this embodiment as the FIG. 1–2 embodiment are given the same number with a prime added. The visor portion mount 31 consists of the firm eye shielding brim 5' attached to a head encircling band 33' along with this band's coextensive upper interior zipper edge strip 25' and the two lower head adjustment straps 9' and 15' (see FIG. 5) previously described in the first embodiment. The spaced vent holes 35 in the joined fabric sections of the crown provide the only real difference between this headpiece and the embodiment shown in FIGS. 1–2.

Figure 4:
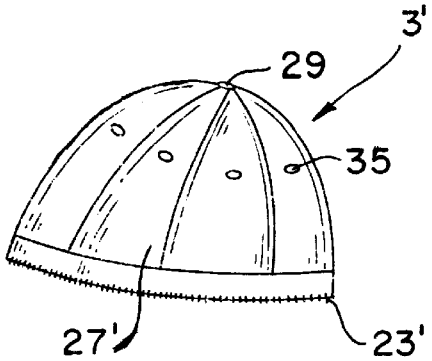
FIG. 4 shows the crown portion component by itself.

FIG. 4 shows the crown portion 3' component of the FIG. 3 embodiment by itself. Like the crown of FIG. 2, this crown has a lower zipper edge strip 23' extending around and fixed its lower interior portion just above where the head receiving crown lower opening is located. There also is an interior elastic band and section strip (not shown) like the respective band 8 and elastic section 28 shown in FIG. 2 to permit the crown to fit different sized heads if woren by itself.

Figure 5:
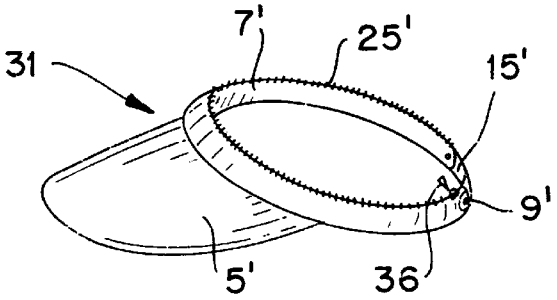
FIG. 5 depicts the visor portion component by itself.

FIG. 5 depicts the second embodiment's visor portion 31 component by itself. As mentioned, this visor has a head encircling strap 7', the adjustment straps 9' and 15' and above these three straps a joined upper zipper edge strip 25' which faces towards and can engage a similar zipper strip 23' (not shown in this figure located on the upper crown portion. A small conventional slidably zipper opener/closing unit 36 having its finger held member facing inwardly is also partially shown in this figure. The unit 36, commonly found in most zippers, is capable of engaging both of the zipper edge strips 25'(or 25) and 23'(or 23) at the same time to force them to mesh together or to open them apart.

Figure 6:
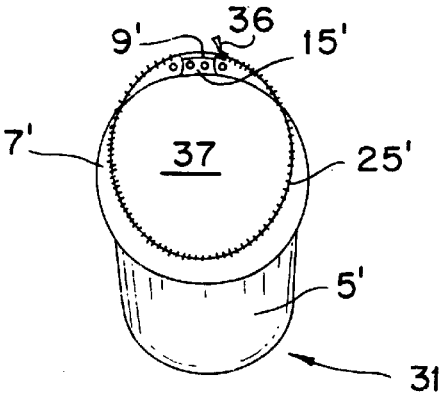
FIG. 6 is a top view of the visor with the crown portion of the head wear removed.

FIG. 6 is a top view of the FIG. 5 visor and has the crown portion of the head wear removed. The head receiving opening 37 is encircled by the strap 7' with its adjustable end straps 9' and 15'. Above these straps is the zipper edge strip 25' which also substantially encircles the formed head opening 37, except for the area above the adjustment straps and the rear opening 17 bridged by them. If such straps were not used, by either providing for an elastic adjustment member totally around the user's head or using different sized head wear without any such straps, then the zipper strip 25' would totally encircle the user's head opening to engage the crown's meshing upper zipper edge strip 23'.

Figure 7:
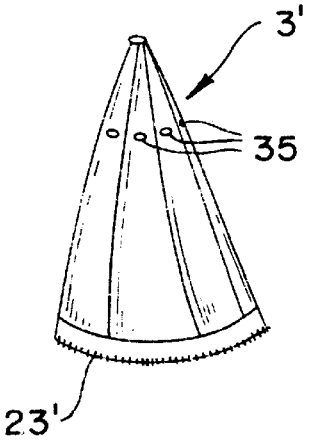
FIG. 7 is a side view of the crown as it is folded together.

FIG. 7 is a side view of the flexible crown 3' as it would appear if folded together on itself. The lower zipper edge strip 23' can fold since it has inherent flexibility and does not extend across the rear opening similar to opening 17 shown in FIG. 2. When so folded the crown portion 3' of the head wear can be placed with the storage bag or container 40 shown in FIG. 8.

Figure 8:
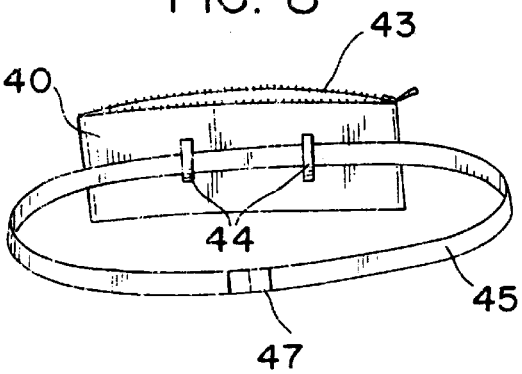
FIG. 8 is a side view of an accessory container for the crown portion that can be fastened around the waist of a user.

FIG. 8 is a side view of an accessory container 40 for the separate crown portion 3' that can be fastened around the waist of a user. This closed bag 40 has an upper closing zipper 43 with two elongated facing meshing zipper edge strips. Two spaced separate loops 44 attached to the same side of the bag 40 mount the waist encircling belt 45 with its end buckle 47. Thus, if a user wishes to use only the visor mount portion, they may place the crown portion into this closed container and fasten the same around their waist by the belt 45. A similar bag could also be used to store the separate visor portion and attach the same to a user's waist if the user only wanted to wear the crown.

Any conventional material may be used to construct the individual described components of the head wear. Since moisture from perspiration may damage some materials, the inter meshing zipper strips should be made of a moisture resistant material such as plastic, stainless steel, etc.

Although the present invention's preferred embodiment and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. An head wear apparatus comprising:

an upper crown portion with a lower head receiving opening, said head receiving opening having a lower zipper edge strip fastener mechanism extending substantially the circumference of the opening;

a lower visor portion having an extending brim and a head receiving strap adapted to fit around the head of a user, said visor portion including an upper zipper edge strip fastener mechanism on the head receiving strap to detachably hold the visor portion to the zipper edge strip fastener mechanism of the upper crown portion; and said zipper edge strips on the crown and visor portions having exterior cover liners to conceal them from view when the head wear is worn.

2. The apparatus as claimed in claim 1, wherein said crown portion is flexible and foldable into a compact shape when detached from the visor portion.

3. The apparatus as claimed in claim 2, also including in combination with said head wear a closable container with a waist attaching strap for storing the folded crown portion therein.

* * * * *